US005259325A

United States Patent [19]

Pilger

[11] Patent Number: 5,259,325

[45] Date of Patent: Nov. 9, 1993

[54] PALLET FOR CARRYING VEHICLE TIRES

[75] Inventor: Josef Pilger, Hasselroth, Fed. Rep. of Germany

[73] Assignee: SP Reifenwerke GmbH, Hanau, Fed. Rep. of Germany

[21] Appl. No.: 785,767

[22] Filed: Oct. 31, 1991

[30] Foreign Application Priority Data

Nov. 22, 1990 [DE] Fed. Rep. of Germany ..... 4037210

[51] Int. Cl.[5] ..... B65D 19/44

[52] U.S. Cl. ..... 108/55.1; 211/23

[58] Field of Search ..... 108/55.1, 51.1; 206/304, 304.2; 211/20, 23, 24

[56] References Cited

U.S. PATENT DOCUMENTS

| | | | |
|---|---|---|---|
| 1,075,801 | 10/1913 | Waters | 211/23 |
| 2,262,794 | 11/1941 | Burbank et al. | 211/23 X |
| 2,632,567 | 3/1953 | Richtmyer | 108/55.1 X |
| 3,352,594 | 11/1967 | Miller | 211/23 X |
| 3,438,343 | 4/1969 | McConnell | 108/55.1 X |
| 3,812,974 | 5/1974 | Sylvester | 211/23 |
| 4,261,470 | 4/1981 | Dolan | 108/55.1 X |

FOREIGN PATENT DOCUMENTS

| | | | |
|---|---|---|---|
| 39166031 | 11/1990 | Fed. Rep. of Germany . | |
| 1500565 | 8/1989 | U.S.S.R. | 211/23 |

*Primary Examiner*—José V. Chen

*Attorney, Agent, or Firm*—Birch, Stewart, Kolasch & Birch

[57] ABSTRACT

In a pallet, in particular for the carrying of vehicle tires comprising a bottom part and two opposite side parts, which are attached perpendicularly to the bottom part to form together with the bottom part a tire-receiving region, and in which tire supporting members are provided in the tire-receiving region, provision is made for a vertically extending introduction slot freely accessible from above in at least one of the side parts, in particular for a tire handling device. This introduction slot allows without problem a deep lowering of rod-like tire handling devices which extend transversely above the side parts.

9 Claims, 2 Drawing Sheets

PALLET FOR CARRYING VEHICLE TIRES

BACKGROUND OF THE INVENTION

The present invention relates to a pallet, in particular for the transport and/or the storage of vehicle tires.

The pallets of the present invention serve to receive tires of different shapes and sizes. In particular, in the case of somewhat larger tires, for example truck tires, there is however the problem that the manual loading and unloading of the pallet is much more difficult or totally impossible because of the high weight of the tire. This problem mainly appears in large volume pallets in which the tires are stacked in several layers above each other.

SUMMARY OF THE INVENTION

It is therefore a principal object of the invention to provide a pallet of the type mentioned above which can be loaded and unloaded in the simplest possible manner.

In accordance with one aspect of the present invention a pallet for carrying vehicle tires comprises a bottom part and two opposite side parts, which are attached perpendicularly to the bottom part to form together with the bottom part a tire-receiving region; tire supporting members provided in the tire-receiving region; and a vertically extending introduction slot freely accessible from above provided in at least one of the side parts for the introduction of a tire handling device which may be brought in above the side part and essentially perpendicularly to the plane of the side part, the lower limit of the introduction slot having a smaller spacing from the tire supporting plane disposed immediately below it than the tire handling device has when depositing the tires onto the tire supporting members.

Due to the construction of the invention, the loading and unloading of the pallet can be effected in a very simple manner with the support of a machine. The loading of the pallet may be for example effected by means of a fork lift truck on which is mounted a tire handling device in the form of a rod pointing in the travelling direction. A plurality of tires can be engaged on this rod. After engagement, the fork lift truck raises the rod together with the tires to a height which makes it possible to drive the fork lift truck up to and close to a front side of the pallet. In this condition the rod is located exactly above the introduction slot and is directed parallel to the longitudinal axis of the pallet. Thereafter, the rod is lowered together with the tires until the tires come to rest in the pallet on the tire supporting members provided for this purpose. The rod is then again slightly lowered and driven rearwardly out of the pallet, while the tires remain standing on the tire supporting members between the side parts of the pallet. The introduction slot provided in the side parts according to the present invention makes possible a lowering of the rod below the lowermost horizontal limit of the side parts, such that the tires can also be laid on lower placed tire supporting members. In the reverse manner, the tires can be removed again from the pallet by means of the fork lift truck and the rod-like tire handing device.

In accordance with an advantageous embodiment of the present invention, an introduction slot is provided in each side part. This makes it possible to use somewhat longer rods without incurring the risk that the free end of the rod gets caught on the side part, remote from the fork lift truck.

In accordance with an advantageous embodiment of the invention the introduction slot is V-shaped and bounded at the side by means of rods. The broad opening of an introduction slot realized in this manner makes possible a simple introduction and lowering of the rod. Furthermore, the loading and unloading can be effected by means of a special gripper. This handling apparatus can handle both standing and lying truck tires by means of its rotatable head part.

BRIEF DESCRIPTION OF THE DRAWINGS

Further aspects of the invention will be apparent from the following description, by way of example, with reference to the drawings in which.

DETAILED DESCRIPTION OF THE INVENTION

Figure 1:
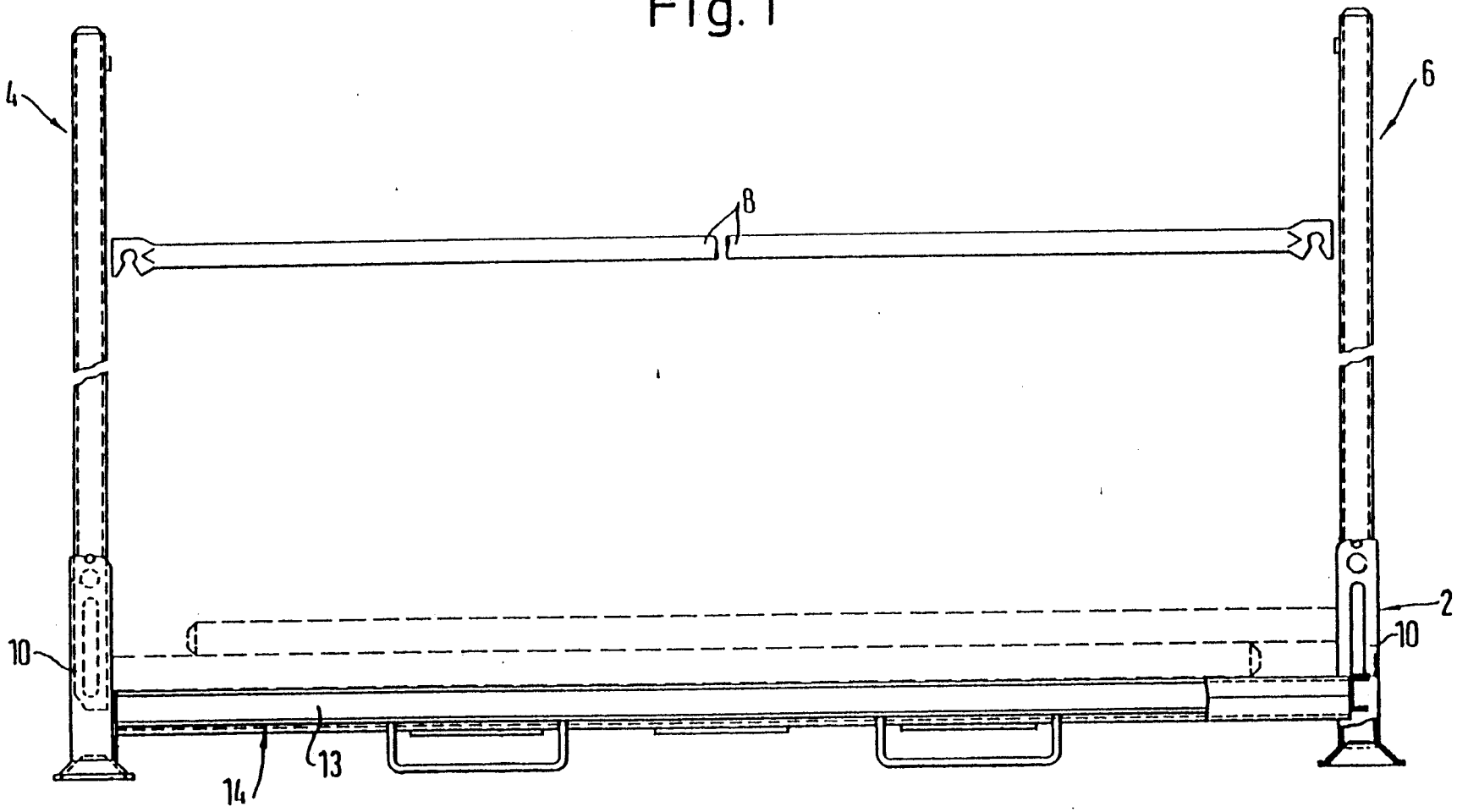
FIG. 1 is a side view of a pallet having upright side parts.
Figure 2:
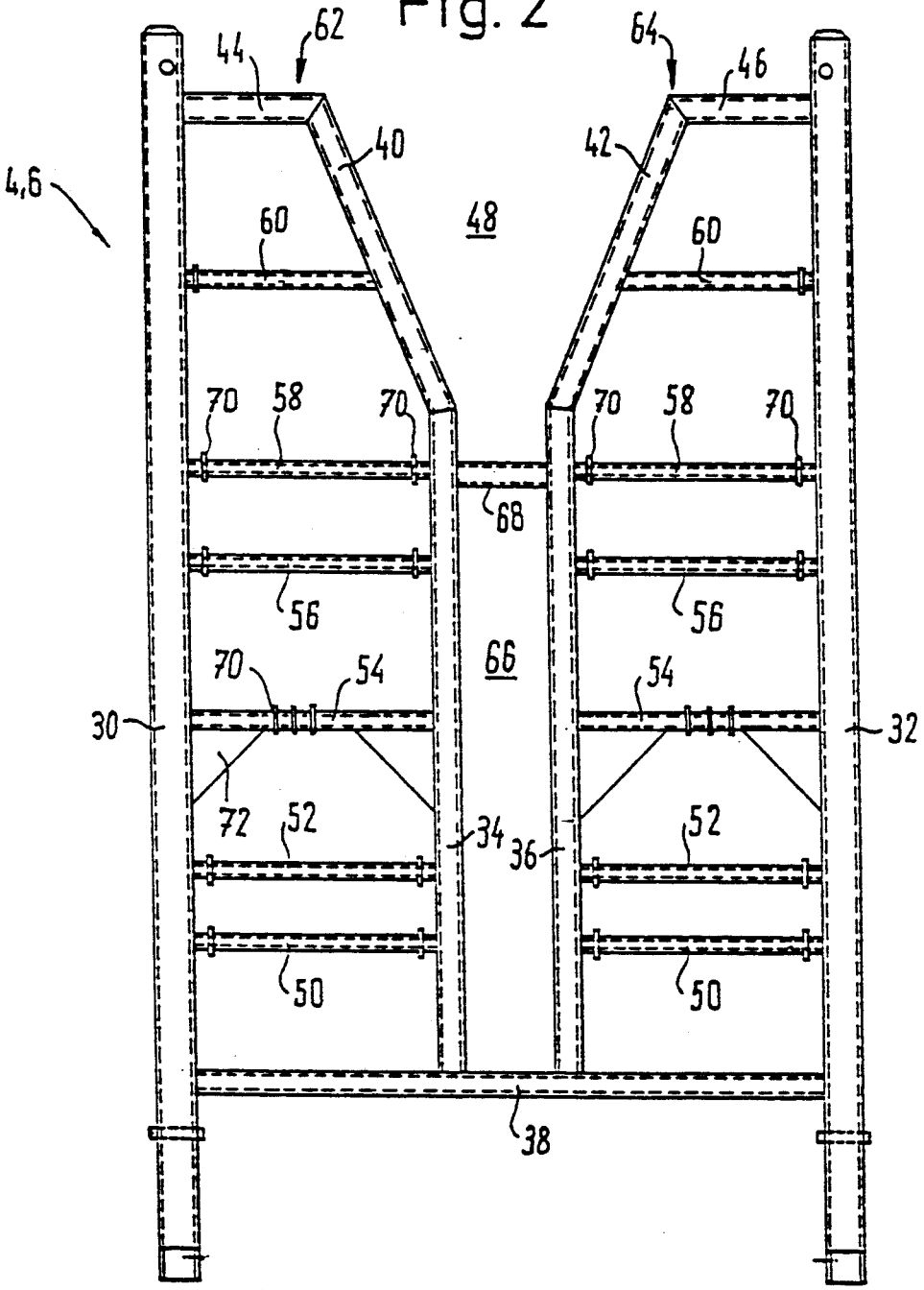
FIG. 2 is a front view of the pallet with one of the side parts separated from the bottom part.
Figure 2:
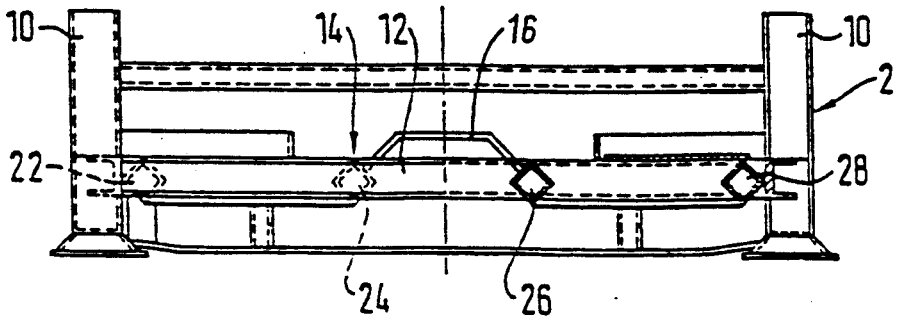

In FIGS. 1 and 2 a pallet consists of a bottom part 2 and two opposite parallel side parts 4,6 in which tire supporting members in the form of carrier rods 8 are hung. The carrier rods 8 are shown in a shortened manner in FIG. 1. The side parts 4,6 are pivotably mounted on the bottom part 2 and can be pivoted inwardly into the position shown in broken lines in FIG. 1.

The bottom part 2 has a rectangular shape and has four standing feet 10 as well as a base frame 14 comprising frame members 12,13.

Two pairs of carrier members 22,24,26,28 are arranged in an horizontal plane between the shorter frame members 12 of the base frame 14. These carrier members extend parallel to each other and to the longer frame members 13 of the base frame 14 and are welded at their ends to the inner sides of the shorter frame members 12. The carrier members 22,24,26,28 serve as supports for a lowermost layer of tires. In order to avoid imprints of the carrier members in the tires, appropriately shaped support plates 16 can be further mounted between the carrier members 24,26 or also between the other carrier members.

As regards further details with respect to the bottom part 2 or with respect to the pivotable connection of the bottom part 2 and the side parts 4,6, reference will be made to German published Patent Application DE-OS-39 16 603.1 which shows in this respect a substantially identical construction.

The side part 4,6 comprises two outer tube-shaped vertical members 30,32 and two shorter inner vertical members 34,36 which extend upwardly from a transverse rod 38 connecting the outer vertical members 30,32 and are welded at their lower ends with this transverse rod 38.

Respective rods 40,42 extending obliquely outwardly towards the outer vertical members 30,32 adjoin the upper ends of the inner vertical members 34,36, which lie substantially below the upper ends of the outer vertical members 30,32. The two rods 40,42 are therefore arranged at a specific angle to each other and diverge upwardly from each other. The upper end of each rod 40,42 is in turn connected to the outer vertical members 30,32 by means of horizontal members 44,46.

Thus, the rods 40,42 form the side limit of a V-shaped introduction slot 48 which can be freely accessed from above. Owing to this introduction slot 48, it is possible to lower a rod having a plurality of tires engaged thereon as far into the pallet as necessary until the tires rest at an appropriate place and the rod can be pulled out from the front side. The introduction slot extends downwardly over at least 25% of the total height of the side parts.

Five horizontal transverse carriers 50,52,54,56,58 arranged respectively at different heights are further welded between a respective inner vertical member 34,36 and a respective outer vertical member 30,32 as well as an uppermost horizontal transverse carrier 60 between a respective rod 40,42 and an outer vertical member 40,32. Each side part 4,6 comprises thus two ladder-like components 62,64 lying in the same plane, in which the transverse carriers are arranged in a rung-like manner, and which are separated from each other by an intermediate space 66 which merges upwardly into the V-shaped introduction slot 48.

In order to increase the stability, the two ladder-like components 62,64 are connected to each other by means of a transverse strut 68 located shortly below the V-shaped introduction slot 48.

The rung-like transverse carriers 50,52,54,56,58,60 serve to suspend the carrier rods 8 on which vehicle tires can be laid. Owing to the plurality of transverse carriers arranged at different heights, it is possible to suspend the carrier rods 8 at different heights in dependence on the tire sizes which are to be transported or stored.

The carrier rods 8 which can be arranged between the side parts 4,6 at a predeterminable distance from the bottom part 2 form one or several intermediate planes for the vehicle tires, such that the tire layer disposed therebelow can no longer be loaded and deformed by the weight of the tire layer disposed thereabove.

In the example shown in FIG. 2, there is provided only one intermediate plane at the height of the transverse carrier 54. The loading of this pallet is that the pallet is firstly filled with tires up to the height of the transverse carrier 54. This can be done manually or with the help of a gripper device which can be lowered between the side parts 4,6 down to the bottom part 2. Thereafter two carrier rods 8 are suspended on the transverse carriers 54 and a row of truck tires can be deposited in a standing fashion on these carrier rods 8. The loading of the pallet with this upper tire row is carried out here by means of a fork lift truck having an engagement rod mounted thereon, which can be lowered from above through the introduction slot 48 together with the tires engaged thereon, until the tires rest on the non-illustrated carrier rods of the transverse carriers 54. The transverse strut 68 between the two ladder-like components 62,64 of the side part 4,6 is mounted in this case so deep that the lowering of the engagement rod down to the required height is not hindered.

In addition to the vertical adjustment possibility of the carrier rod 8, the mutual horizontal distance of the carrier rod 8 can also be varied. This occurs by means of horizontal abutments 70 which are mounted on each transverse carrier at a determined distance from the outer vertical members 30,32.

The horizontal abutments 70 consist advantageously of ring-shaped collars having a larger diameter than the diameter of the transverse carrier and the periphery of which is flattened in the shape of a secant on the side directed towards the facing side part. This secant-like flattening of the horizontal abutment ensures a greater contact surface on the bottom part when the side parts are pivoted inwardly.

If two carrier rods 8 are suspended on the transverse rod at a determined horizontal distance from each other, the carrier rods 8 are pushed against the respective closest horizontal abutment 70 by the tires themselves in the case of standing tire storage. The abutments prevent a further outward displacement of the carrier rods 8. Furthermore, it is also possible to arrange two horizontal abutments near each other at a relatively small distance on the same transverse carrier, such that a carrier rod 8 can be hung between these two horizontal abutments and is securely held from both sides against horizontal displacement.

In order to increase the supporting capability of the individual transverse carriers, it is further possible to provide supporting plates 72 or braces between the transverse rod and the vertical members.

Within the scope of the invention it is also possible to provide other shapes of introduction slots instead of a V-shaped introduction slot. It is thus possible to lead the inner vertical members 34,36 up to the upper horizontal members 44,46 and to weld the inner vertical members to these upper horizontal members. In this case there would be a parallel introduction slot defined by the intermediate space 66 between the inner vertical members 34,36.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Having now described the invention, what I claim is:

1. A pallet for carrying vehicle tires, comprising a bottom part and two opposite side parts, which are attached perpendicularly to the bottom part to form together with the bottom part a tire-receiving region, tire supporting members provided in the tire-receiving region, a vertically extending introduction slot disposed in an intermediate space which is provided between two ladder-like components of said side parts, said ladder-like components lying in the same plane and comprising outer and inner vertical members connected with transverse carriers arranged at different heights, said introduction slot extending from a topmost transverse carrier to a lowermost transverse carrier, said introduction slot being freely accessible from above and provided in at least one of the side parts for the introduction of a tire handling device which may be brought in above the side part and essentially perpendicularly to the plane of the side part, the introduction slot being narrower adjacent the lowermost transverse carrier than at or near the topmost transverse carrier having a lower limit with a smaller spacing from a tire supporting plane disposed immediately below it than the tire handling device has when depositing the tires onto the tire supporting members.

2. The pallet according to claim 1, wherein an introduction slot is provided in each side part.

3. The pallet according to claim 1, wherein the introduction slot is V-shaped.

4. The pallet according to claim 1, wherein the introduction slot is bounded at the sides by means of rods.

5. The pallet according to claim 4, wherein rods which bind the introduction slot at the sides are attached, in particular welded, at their lowest ends to the upper ends of the inner vertical members of the ladder-like components of the side part and at their upper ends to the outer vertical members by means of uppermost horizontal members.

6. The pallet according to claim 1, wherein the introduction slot extends downwardly over at least 25% of the total height of the side parts.

7. The pallet according to claim 1, wherein the distance between the ladder-like components is less than the width of one of the ladder-like components.

8. The pallet according to claim 1, wherein the two ladder-like components of the side part are connected to each other by means of at least one transverse strut located above the uppermost tire support plane that is used.

9. The pallet according to claim 1, wherein the tire bearing members consist at least partly of carrier rods which are suspended in the transverse carriers of the ladder-like components.

* * * * *